US010780951B2

(12) United States Patent
Daley et al.

(10) Patent No.: US 10,780,951 B2
(45) Date of Patent: Sep. 22, 2020

(54) MARINE THRU-HULL FITTING AND DRAINAGE DEVICE

(71) Applicant: C&D MARINE PRODUCTS, LLC, Maryville, TN (US)

(72) Inventors: Colin Daley, Clinton, TN (US); Dale Branch, Maryville, TN (US)

( * ) Notice: Subject to any disclaimer, the term of this patent is extended or adjusted under 35 U.S.C. 154(b) by 4 days.

(21) Appl. No.: 16/142,049

(22) Filed: Sep. 26, 2018

(65) Prior Publication Data

US 2019/0023354 A1 Jan. 24, 2019

Related U.S. Application Data

(63) Continuation-in-part of application No. 15/923,059, filed on Mar. 16, 2018, which is a continuation-in-part of application No. 15/457,435, filed on Mar. 13, 2017, now Pat. No. 9,919,766.

(60) Provisional application No. 62/332,532, filed on May 6, 2016.

(51) Int. Cl.

| | |
|---|---|
| ***B63B 13/02*** | (2006.01) |
| ***B63B 59/04*** | (2006.01) |
| ***B63B 13/00*** | (2006.01) |

(52) U.S. Cl.

CPC ..... *B63B 13/02* (2013.01); *B63B 13/00* (2013.01); *B63B 59/04* (2013.01)

(58) Field of Classification Search

CPC ..... B63B 13/00; B63B 13/02; B63B 59/00; B63B 59/04; B63B 17/00; B63B 17/02; B63B 25/00; B63B 25/08

USPC ..... 114/183 R, 197

See application file for complete search history.

(56) References Cited

U.S. PATENT DOCUMENTS

| | | | | |
|---|---|---|---|---|
| 6,164,231 A * | 12/2000 | Shimmell | ..... | B63B 13/02 114/182 |
| 9,371,112 B2 * | 6/2016 | Sarnowski | ..... | B63B 13/02 |
| 9,919,766 B2 * | 3/2018 | Daley | ..... | B63B 13/02 |

* cited by examiner

*Primary Examiner* — Lars A Olson
(74) *Attorney, Agent, or Firm* — Matthew M. Googe; Robinson IP Law, PLLC

(57) ABSTRACT

A marine thru-hull fitting drainage device includes: a channel body having a substantially U-shaped cross-sectional area along a length of the body such that the body forms a channel for directing fluid within the body, the body extending from a first end proximate to the hull of the vessel when the drainage device is installed and a second end that is distal from the hull of the vessel, wherein the second end extends beyond an edge of the thru-hull fitting; and a ring having an inner diameter that is at least as wide as a diameter of the bore in the hull of the vessel, the resiliently flexible channel body attached to the ring at the first end of the channel body. The drainage device is secured to the hull of the vessel by securing the ring between the thru-hull and the hull of the vessel.

13 Claims, 20 Drawing Sheets

MARINE THRU-HULL FITTING AND DRAINAGE DEVICE

CROSS-REFERENCE TO RELATED APPLICATION

This application is a continuation-in-part of U.S. patent application Ser. No. 15/923,059 for a Marine Thru-hull Fitting and Drainage Device, filed on Mar. 16, 2018, which is a continuation-in-part of U.S. patent application Ser. No. 15/457,435 for a Marine Thru-hull Fitting Drainage Device, filed on Mar. 13, 2017, which claims priority to U.S. Provisional Patent Application No. 62/332,532 for a Marine Thru-Hull Fitting Drainage Device, filed on May 6, 2016, the contents of which are incorporated herein by reference in their entireties.

FIELD

This disclosure relates to the field of marine and boating accessories. More particularly, this disclosure relates to accessories for preventing buildup of drainage streaks on a hull of a vessel.

BACKGROUND

Boats and marine vessels are often fitted with thru-hull fittings that extend through a hull of the vessel to allow for discharge of a fluid from the vessel. These thru-hull fittings are typically mounted flush with a surface of the vessel's hull. Thru-hull fittings provide a drainage point for fluids discharged from the boat, such as for a bilge pump, live well, or other pump or fluid source on the boat.

When a fluid is discharged from the thru-hull fitting, at least a portion of the fluid drains along a surface of the vessel's hull given the flush-mounted position of the thru-hull fitting. As the fluid drains down a surface of the vessel's hull, the fluid often stains the hull of the vessel and leaving behind discolored streaks on the hull, as shown in FIG. 1. These streaks build up over time, and removal of the staining or streaks caused by drainage of fluid from the thru-hull fitting is extremely difficult.

Attempts have been made to direct fluid exiting a thru-hull fitting away from a vessel's hull. For example, attempts have been made to attach a drainage channel with a gasket to direct fluid away from the vessel's hull. Further attempts involve replacing the thru-hull fitting itself with a shaped fitting that attempts to direct fluid away from the hull. These attempts often do not adequately divert water away from the hull and are otherwise difficult to install. These devices are also typically inflexible and subject to breaking if the hull contacts a dock or other surface.

What is needed, therefore, is a boat thru-hull fitting and drainage device that is readily installed on the hull of the boat to direct discharge fluid from the thru-hull fitting away from the hull.

SUMMARY

A marine thru-hull fitting drainage channel is provided for directing fluid away from a thru-hull fitting in a hull of a vessel. In a first aspect, the drainage device includes: a channel body having a substantially U-shaped cross-sectional area along a length of the body such that the body forms a channel for directing fluid within the body, the body extending from a first end proximate to the hull of the vessel when the drainage device is installed and a second end that is distal from the hull of the vessel, wherein the second end extends beyond an edge of the thru-hull fitting; and a ring having an inner diameter that is at least as wide as a diameter of the bore in the hull of the vessel, the resiliently flexible channel body attached to the ring at the first end of the channel body. The drainage device is secured to the hull of the vessel by securing the ring between the thru-hull and the hull of the vessel.

In one embodiment, the channel body and ring are formed of a resiliently flexible material. In another embodiment, the channel body tapers in width from the first end adjacent to the hull to the second end of the channel body.

In yet another embodiment the channel body further comprises a groove formed at a center of the channel body. In one embodiment, the groove has a tapered width such that a width of the groove expands from a narrower width at a first end to a wider width at a second end of the groove, wherein the second end of the groove is adjacent the second end of the channel body.

In another embodiment, the drainage device further includes a lip formed on a lower surface of the channel body and extending downward from the channel body at the second end of the channel body. In yet another embodiment, the drainage device further includes a lip formed on a lower surface of the channel body and extending downward from the channel body at the second end of the channel body, the lip aligned with the groove formed in the channel body.

In one embodiment, the channel body has a width that is greater than a width of the ring.

In a second aspect, a marine thru-hull drainage device includes: a channel body having a substantially U-shaped cross-sectional area along a length of the body such that the body forms a channel for directing fluid within the body, the body extending from a first end proximate to the hull of the vessel when the drainage device is installed and a second end that is distal from the hull of the vessel, wherein the second end extends beyond an edge of the thru-hull fitting, the channel body tapering in width from the first end adjacent to the hull to the second end of the channel body; and a ring having an inner diameter that is at least as wide as a diameter of the bore in the hull of the vessel, the resiliently flexible channel body attached to the ring at the first end of the channel body. The drainage device is secured to the hull of the vessel by securing the ring between the thru-hull and the hull of the vessel. The channel body and ring are formed of a resiliently flexible material.

In one embodiment, the channel body further comprises a groove formed at a center of the channel body. In another embodiment, the groove has a tapered width such that a width of the groove expands from a narrower width at a first end to a wider width at a second end of the groove, wherein the second end of the groove is adjacent the second end of the channel body. In yet another embodiment, the drainage device further includes a lip formed on a lower surface of the channel body and extending downward from the channel body at the second end of the channel body.

In one embodiment, the drainage device further includes a lip formed on a lower surface of the channel body and extending downward from the channel body at the second end of the channel body, the lip aligned with the groove formed in the channel body. In another embodiment, the channel body has a width that is greater than a width of the ring.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

A marine thru-hull fitting drainage device 10 is provided for directing fluid from a thru-hull fitting installed through the hull of a marine vessel away from the hull to reduce the formation of streaks or other stains on the surface of the hull caused by fluid from the thru-hull fitting. In one embodiment, the thru-hull fitting drainage device is readily installed on the hull of a vessel adjacent an outlet of the thru-hull fitting without requiring removal or loosening of the thru-hull fitting and is shaped to direct fluid discharged from the thru-hull fitting outlet away from the hull of the vessel.

Figure 1:
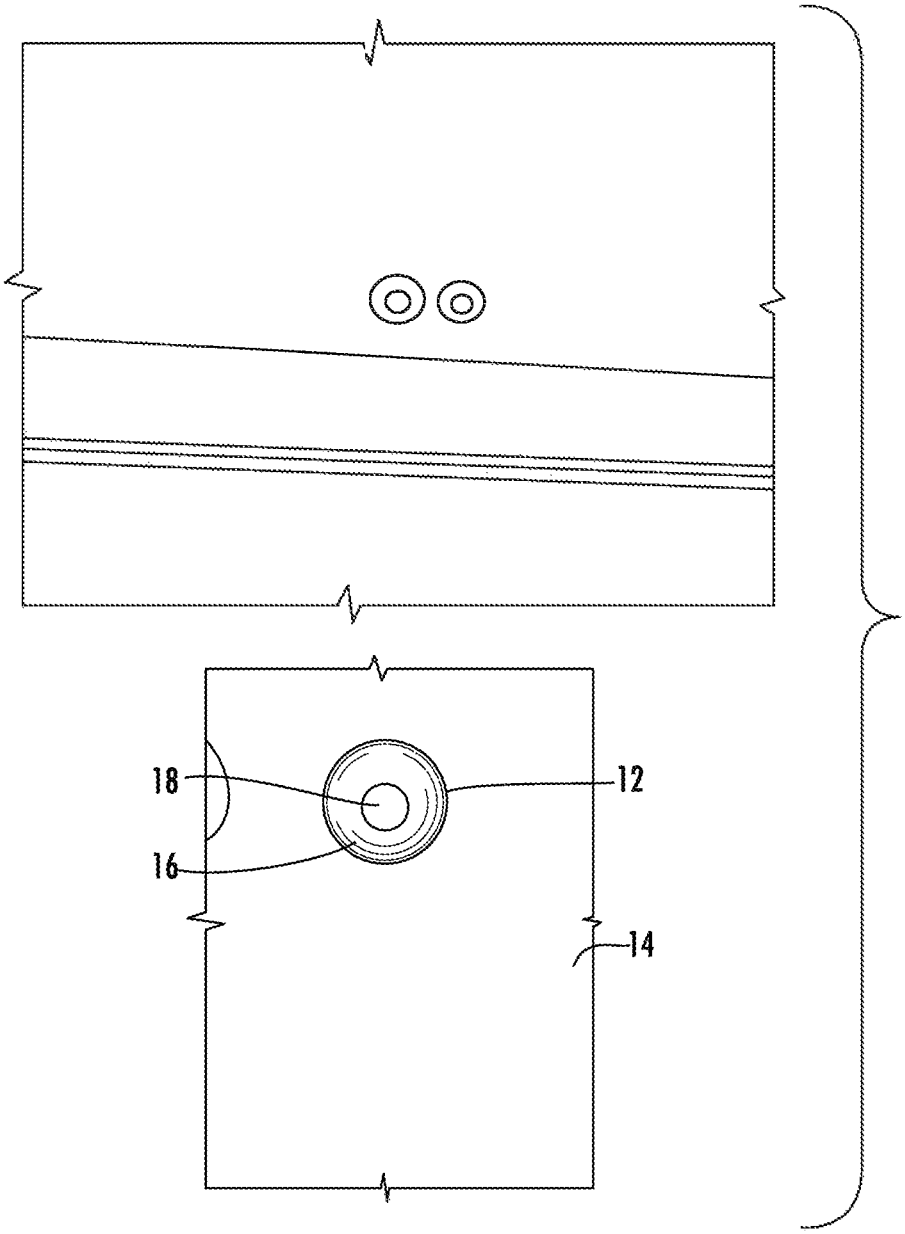
FIG. 1 shows a thru-hull fitting installed on a hull of a vessel according to one embodiment of the present disclosure.

Referring to FIG. 1, a typical thru-hull fitting 12 is installed on a hull 14 of a vessel, the thru hole fitting including a thru-hull fitting flange 16 shaped to conform to the hull 14 of the vessel. The thru-hull fitting 12 includes a discharge outlet 18 through which fluid from a hose attached to the thru-hull fitting 12 on an inner side of the hull 14 is discharged. The thru-hull fitting flange 16 is substantially flat such that the flange 16 is flush to the hull 14 or does not extend significantly beyond a surface of the hull 14. The thru-hull fitting flange 16 is generally circular in shape, however, it is also understood that the thru-hull fitting flange 16 may be formed into various other shapes.

Figure 2:
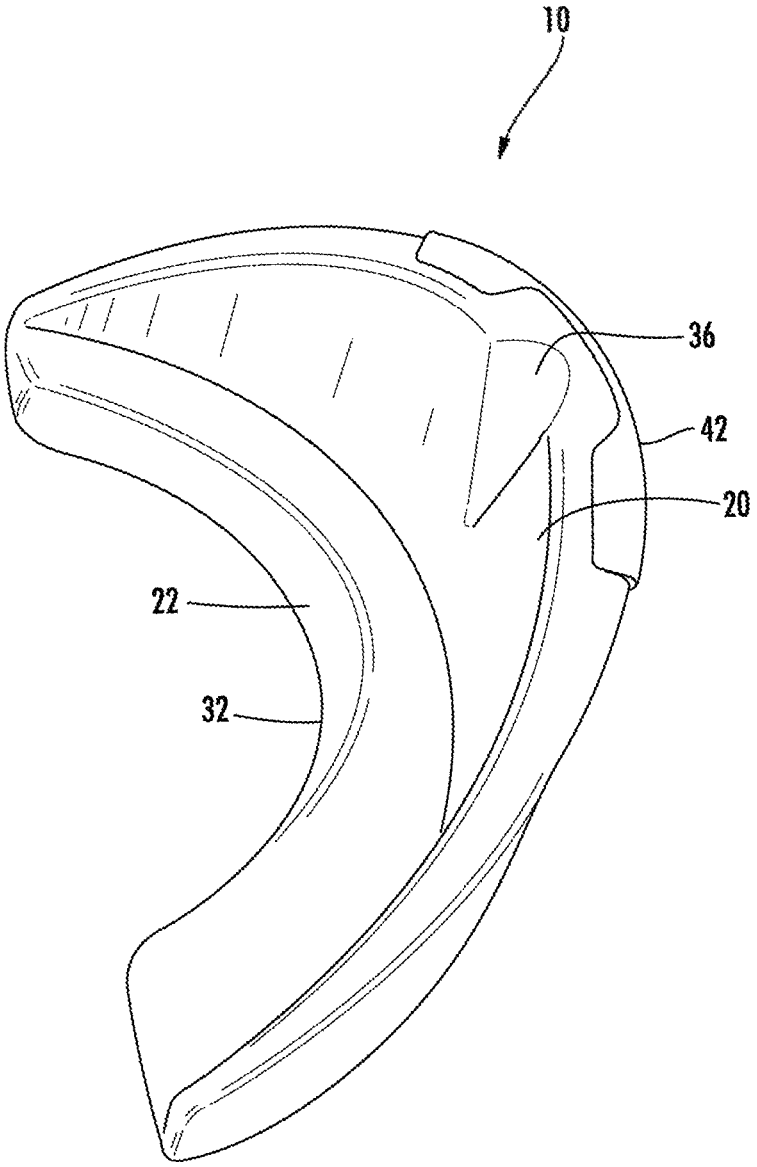
FIG. 2 shows a perspective view of a thru-hull drainage device according to one embodiment of the present disclosure.
Figure 5:
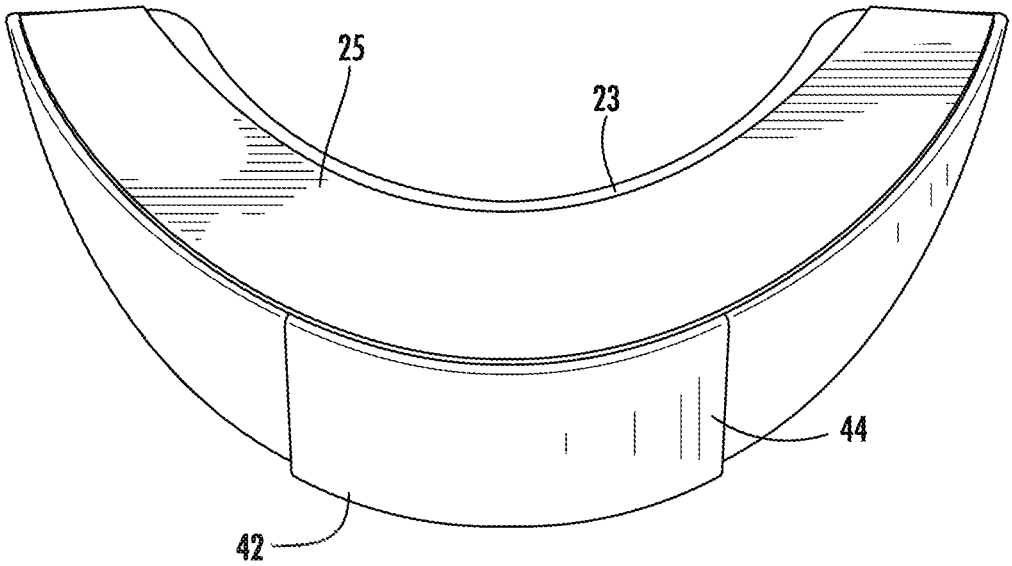
FIG. 5 shows a perspective rear view of a thru-hull drainage device according to one embodiment of the present disclosure.
Figure 6:
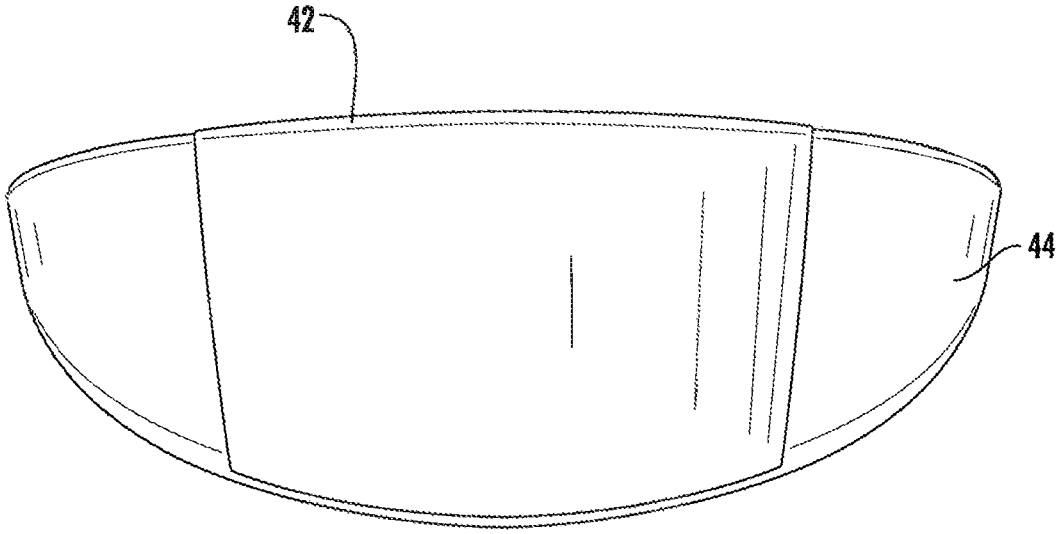
FIG. 6 shows a bottom view of a thru-hull drainage device according to one embodiment of the present disclosure.

As shown in FIG. 2, the marine thru-hull fitting drainage device 10 is formed of a channel body 20 and a flange 22 formed on an end of the channel body 20 adjacent the vessel's hull. The flange 22 includes a surface 23 for receiving an adhesive 25 (FIG. 5) to secure the drainage device 10 to the hull 14 of the vessel.

Figure 3:
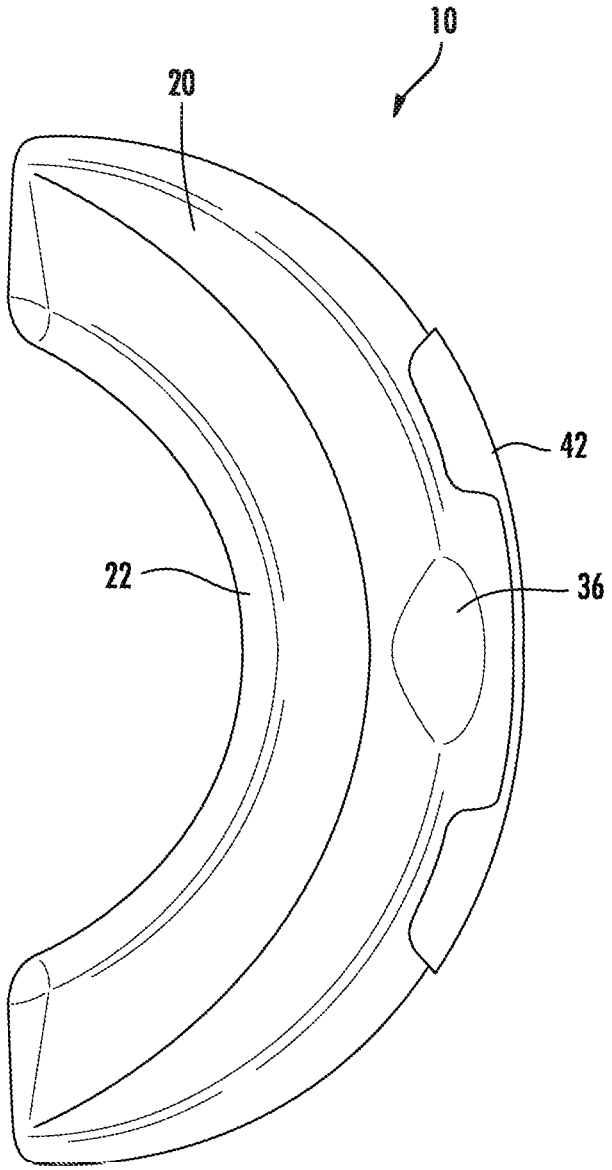
FIG. 3 shows a front view of a thru-hull drainage device according to one embodiment of the present disclosure.

Referring now to FIG. 3, the channel body 20 is formed into a U-shape along a length of the elongate channel body such that a cross-sectional area of the elongate channel body when looking along a length of the elongate channel body 20 is substantially cupped in shape. The U-shaped channel body 20 urges a fluid received in the elongate channel body 20 towards a bottom of the channel body 20 to maintain fluid within the channel body 20. The elongate channel body 20 preferably has a uniform U-shaped cross-sectional area along a length of the channel body 20. Alternatively, the channel body 20 may have a U-shaped cross-sectional area that varies from a width that is greatest at a point adjacent the hull of the vessel and narrowest at a point distal from the hull of the vessel such that the channel body 20 forms a spout at a distal end of the channel body 20.

Figure 4:
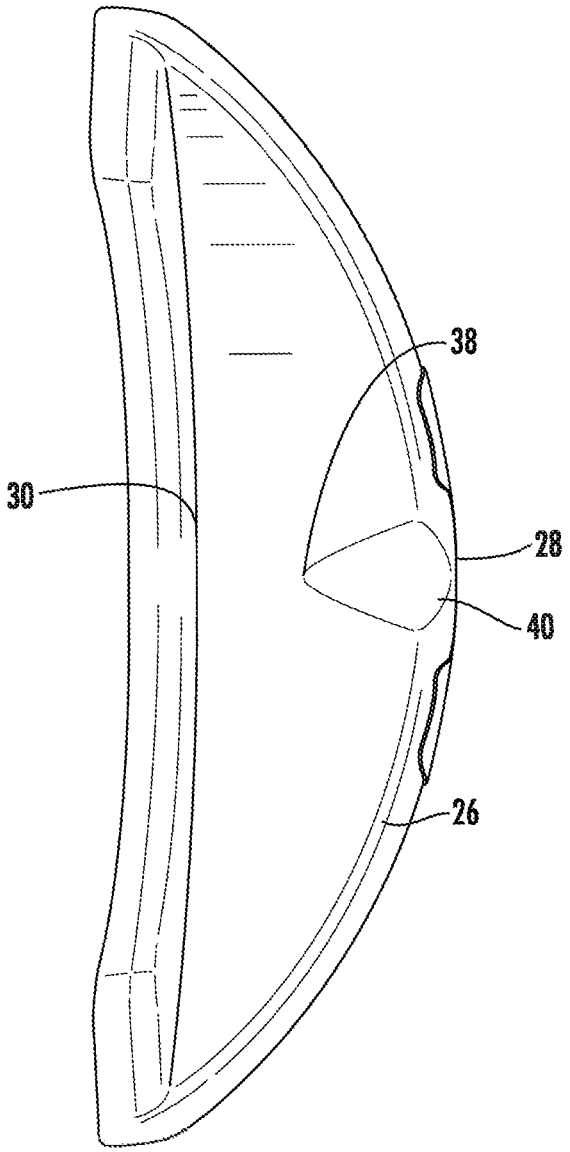
FIG. 4 shows a top view of a thru-hull drainage device according to one embodiment of the present disclosure.

The channel body 20 has a first end 30 (FIG. 4) that is adjacent to the hull of the vessel and a second end 26 at a point that is distal from the hull of the vessel when the thru-hull fitting drainage device 10 is affixed to the vessel. As shown in FIG. 4, the first end 30 of the channel body 20 is substantially flat when viewed from above, such that the first end 30 of the channel body 20 conforms to a shape of the hull of the vessel. The second end 26 of the channel body 20 is preferably rounded or tapered, such that the second end 26 of the channel body 20 narrows to a tip 28 of the channel body 20. The channel body 20 preferably has a length of from about ¼ to about 2 inches, and has a length such that the tip 28 of the channel body 20 terminates at a point that is beyond an outermost edge of the thru-hull fitting flange 16.

Referring again to FIG. 3, the flange 22 is attached to the first end 30 of the channel body 20. The flange 22 has a shape that conforms to the U-shaped cross-sectional area of the channel body 20. The flange 22 is preferably attached to the first end 30 of the channel body 20, and extends perpendicular to the channel body 20 to an inner edge 32. Surface 23 is formed between the first end 30 of the channel body 20 and inner edge 32. The inner edge 32 is shaped to conform to the hull of the vessel around a circumference of the thru-hull fitting flange 16. While the figures illustrate the flange 22 and channel body 20 being attached to one another at the first end 30 of the channel body 20, it is also understood that the channel body 20 may be attached to the flange 22 at the inner edge 32 of the flange 22, or at a point between the first end 30 of the channel body 20 and inner edge 32.

The channel body 20 and flange 22 are preferably made of a resiliently flexible material, such as a polymer or rubber-like material. The channel body 20 and flange 22 are preferably flexible such that if the drainage device 10 contacts a dock or other object near a vessel, the channel body 20 flexes relative to the hull of the vessel to prevent the drainage device 10 from being removed from the hull. In one embodiment, the channel body 20 may be formed of a resiliently flexible material, while the flange 22 is formed of a substantially solid polymer or metal material. The channel body 20 and flange 22 preferably have a thickness of from about 1/16 inches to about 3/16 inches.

The surface 23 of the flange 22 is shaped to conform to a shape of the hull of the vessel around the thru-hull fitting such that the surface 23 is flush with the hull of the vessel. The surface 23 is preferably flat and U-shaped to conform to a shape of the channel body 20. The flange 22 is attached to the channel body 20 such that the surface 23 is perpendicular to a length of the channel body 20. Alternatively, the flange 22 may be attached to the channel body 20 at an angle, such that the surface 23 is angled relative to a length of the channel body 20. The flange 22 and channel body 20 may be angled such that when the drainage device 10 is mounted to the hull of a vessel adjacent a thru-hull fitting, the channel body 20 angles in a downward direction from the first end 30 to the second end 26 of the channel body 20 to encourage water within the channel body 20 towards the tip 28 of the channel body 20.

In one embodiment, an adhesive such as tape, glue, or other type of adhesive is placed on the flange 22 of the drainage device 10 to secure the device to the hull of the boat. The adhesive is preferably formed of a U-shaped adhesive strip attached on a first side to the surface 23. The adhesive strip may have an adhesive surface on both the first side and a second side facing away from the flange 22 such that the second side of the adhesive attaches to the hull of a vessel. A non-adhesive layer may be placed over the second side of the adhesive strip to substantially conceal the adhesive second side until a user is ready to install the drainage device on the hull of a boat. A suitable adhesive may include, for example, an automotive adhesive available from 3M®. While the above description contemplates an adhesive strip applied to the flange 22, it is also understood that other various adhesives may be used. For example, a liquid adhesive may be applied to the flange 22 upon installation.

Embodiments of the drainage device 10 include a groove 36 formed in the channel body 20 for further diverting water along the drainage device 10 and away from the hull. The groove 36 is preferably located at a center of the channel body 20 and is formed on a surface of the channel body 20 for collecting water received by the drainage device 10 and dispensing the collected water from a central portion of the drainage device 10. The groove 36 begins at a first end 38 that is proximate to the flange 22 and extends to a second end 40 adjacent the tip 28 of the drainage device 10. As shown in FIG. 2, the first end 38 of the groove 36 may be located proximate to but spaced apart from the flange 22. However, it is also understood that the groove 36 may be located directly adjacent the flange 22. The groove 36 is preferably formed having a tapered width such that a width of the groove 36 expands from a narrower width at the first end 38 to a wider width at the second end 40. Further, the groove 36 is preferably sloped such that a depth of the groove increases from a shallow portion at the first end 38 of the groove 36 to a deeper portion at the second end 40 of the groove 36.

Figure 7:
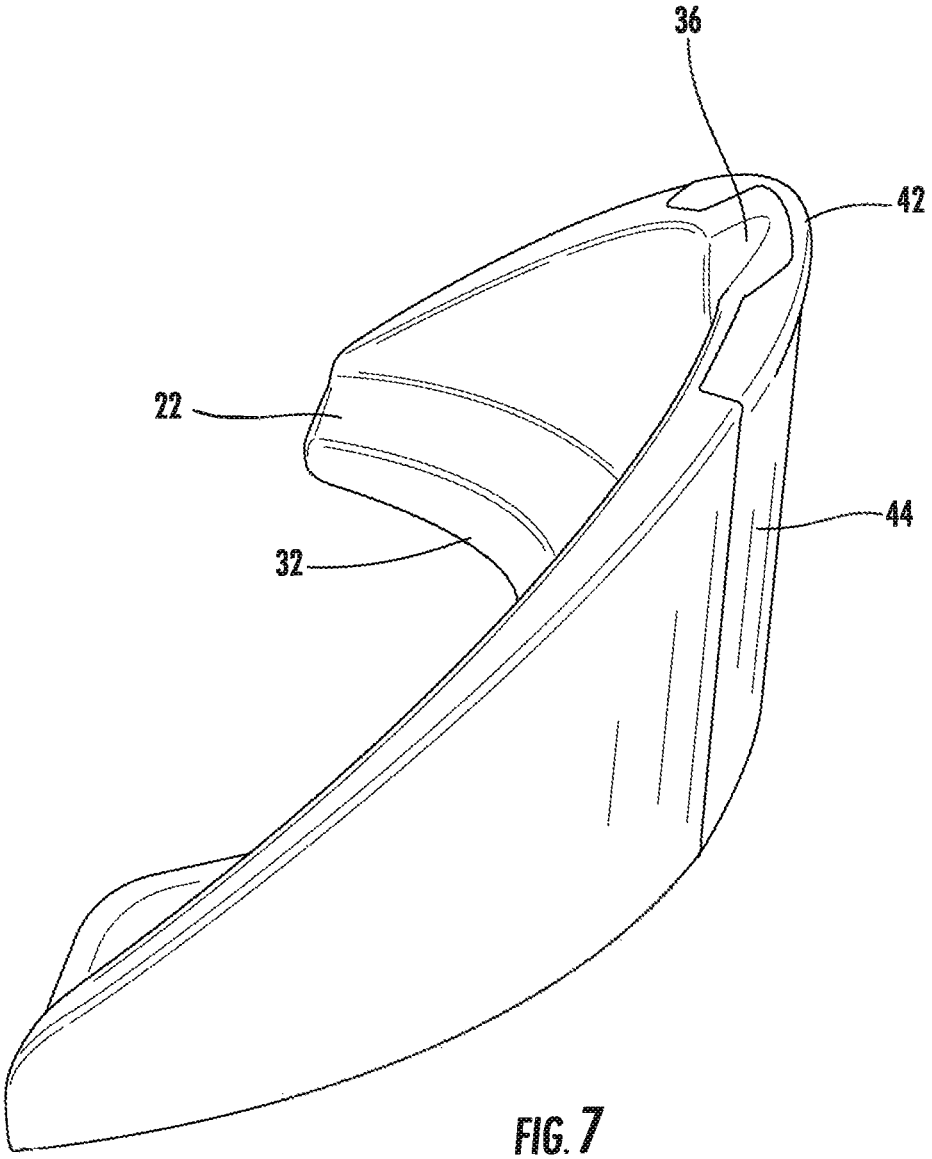
FIG. 7 shows a perspective side view of a thru-hull fitting drainage device according to one embodiment of the present disclosure.
Figure 8:
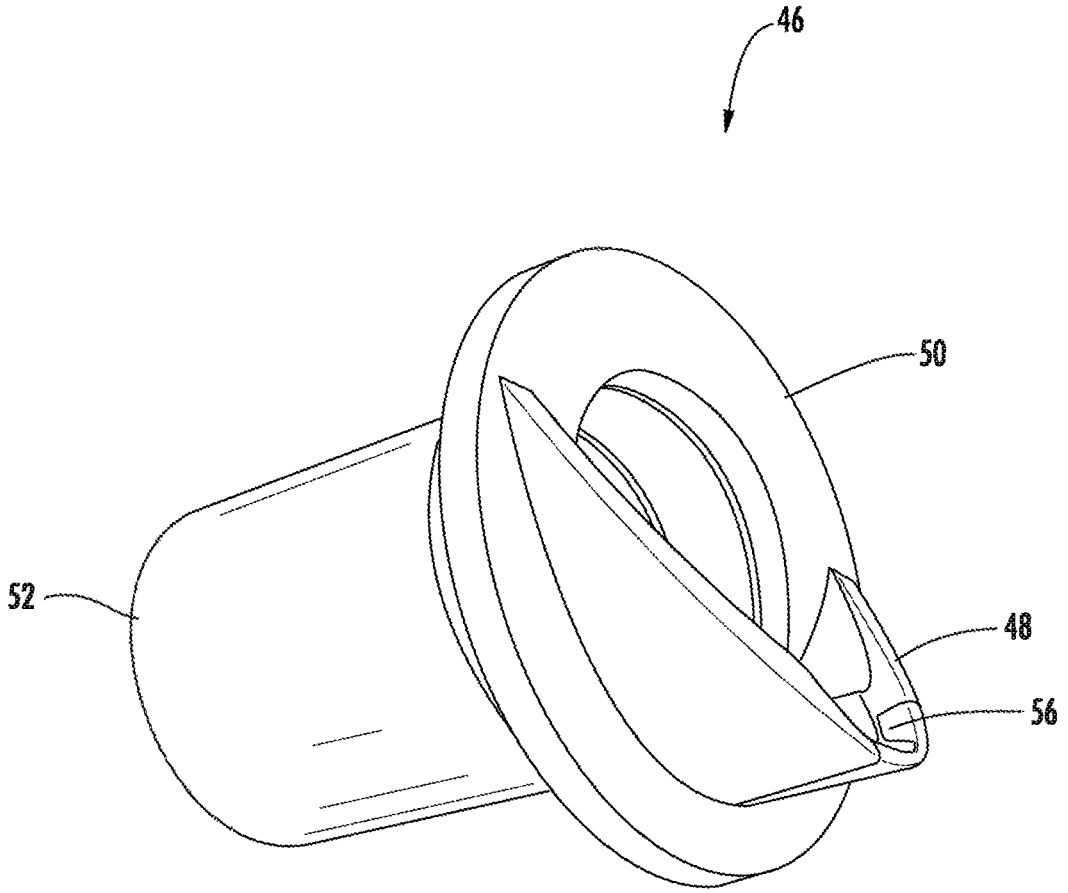
FIG. 8 shows a perspective view of a combination drainage device and thru-hull fitting according to one embodiment of the present disclosure.
Figure 9:
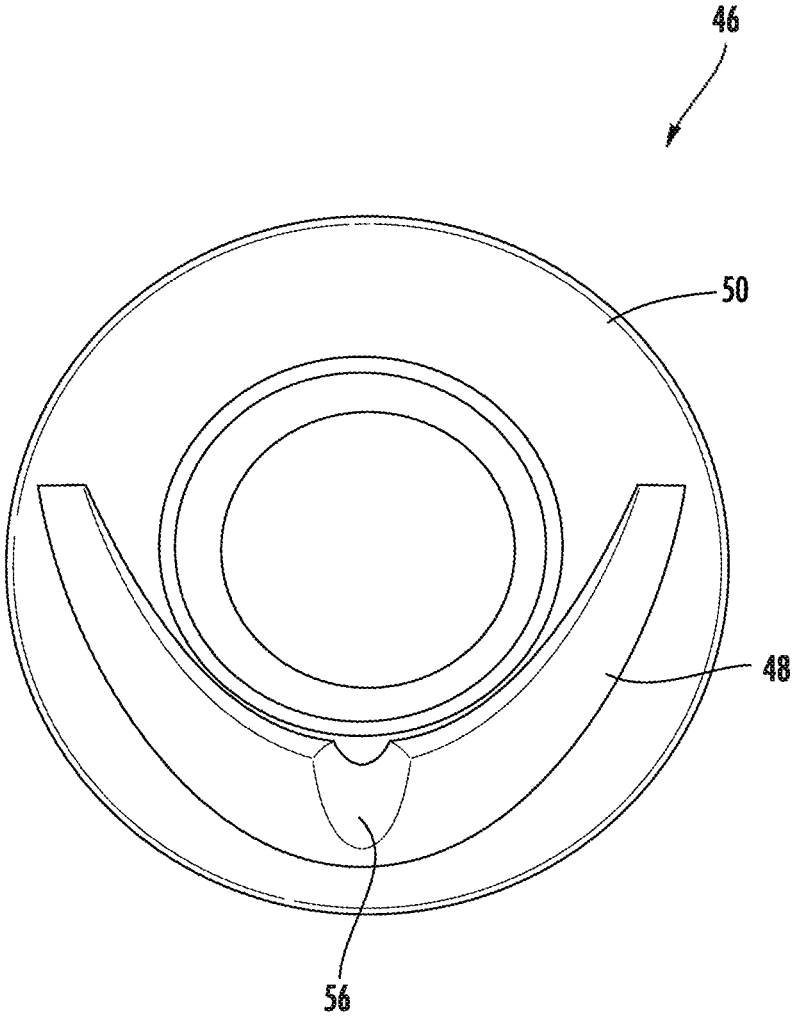
FIG. 9 shows a front view of a combination drainage device and thru-hull fitting according to one embodiment of the present disclosure.
Figure 10:
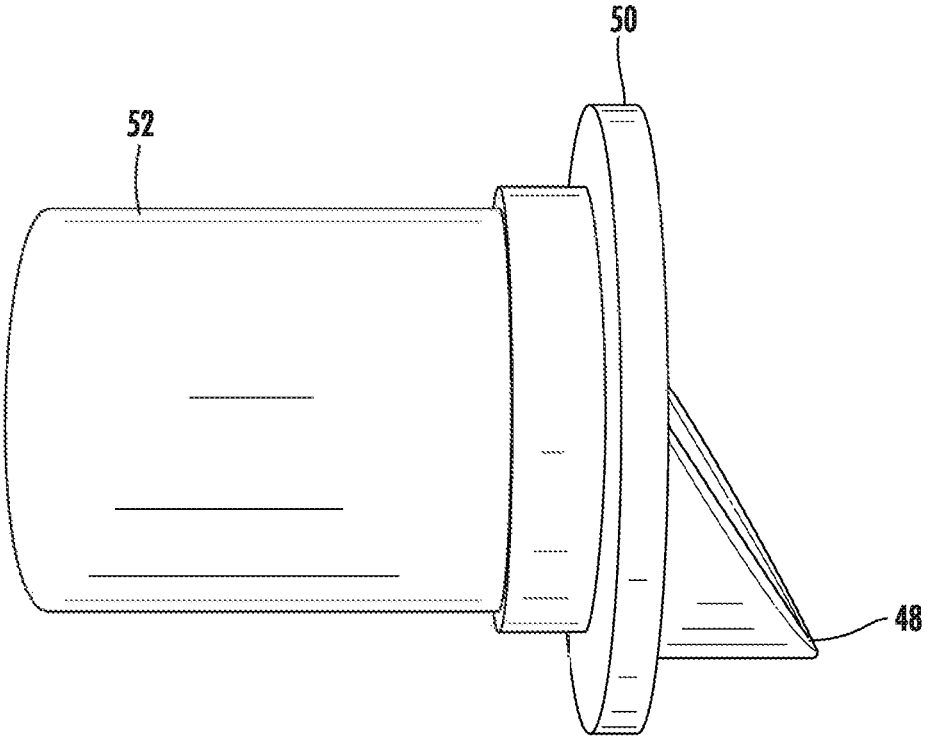
FIG. 10 shows a side view of a combination thru-hull fitting and drainage device according to one embodiment of the present disclosure.
Figure 11:
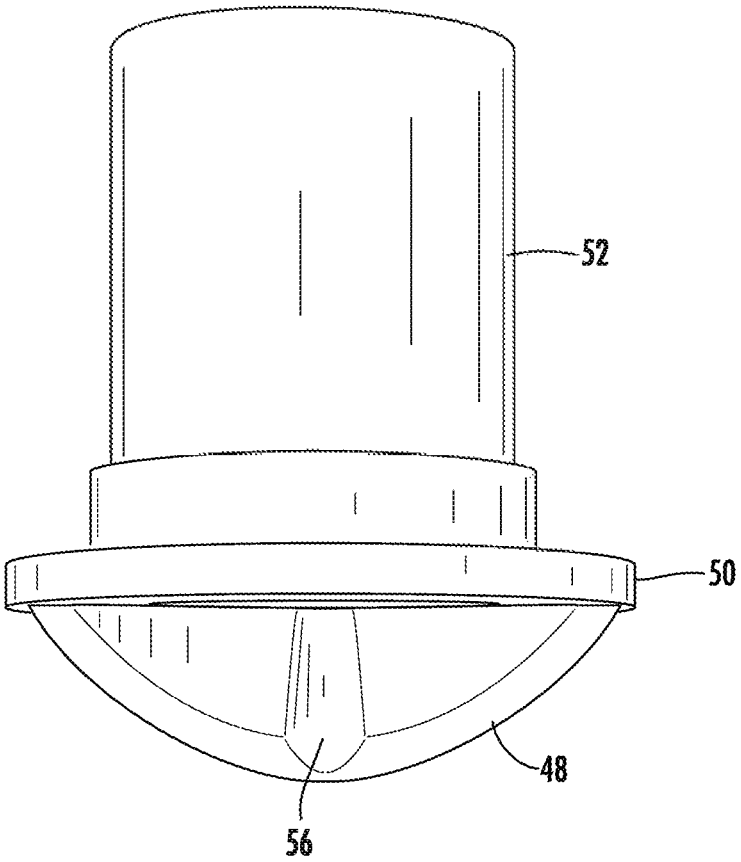
FIG. 11 shows a top view of a combination thru-hull fitting and drainage device according to one embodiment of the present disclosure.
Figure 12:
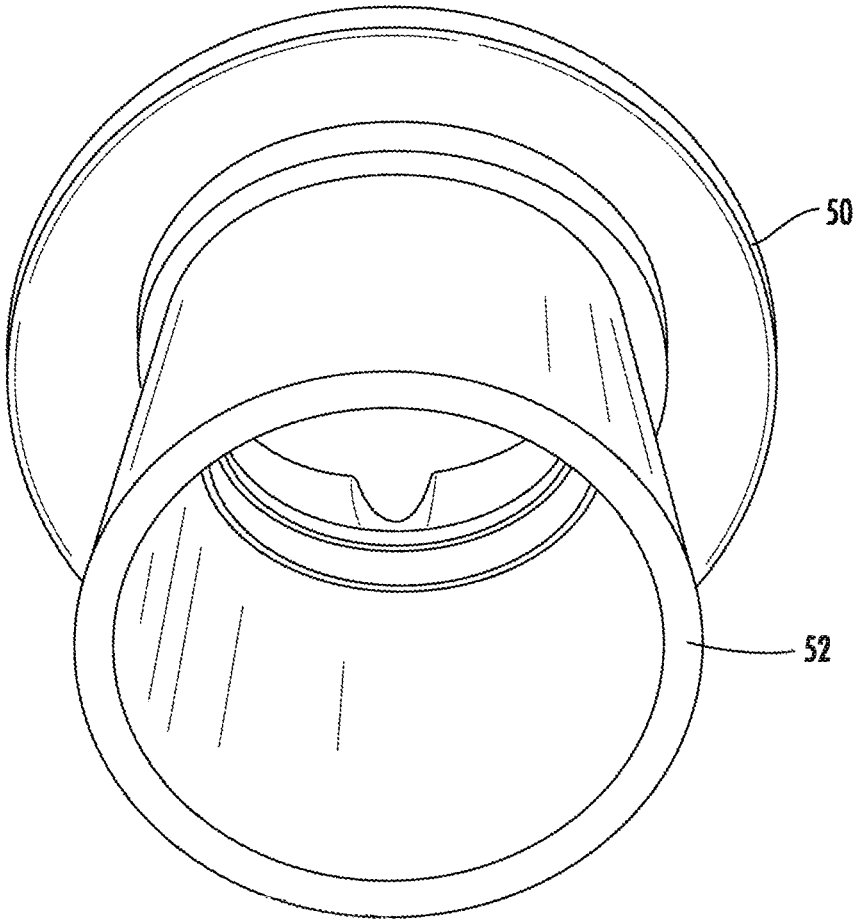
FIG. 12 shows a rear view of a combination thru-hull fitting and drainage device according to one embodiment of the present disclosure.
Figure 13:
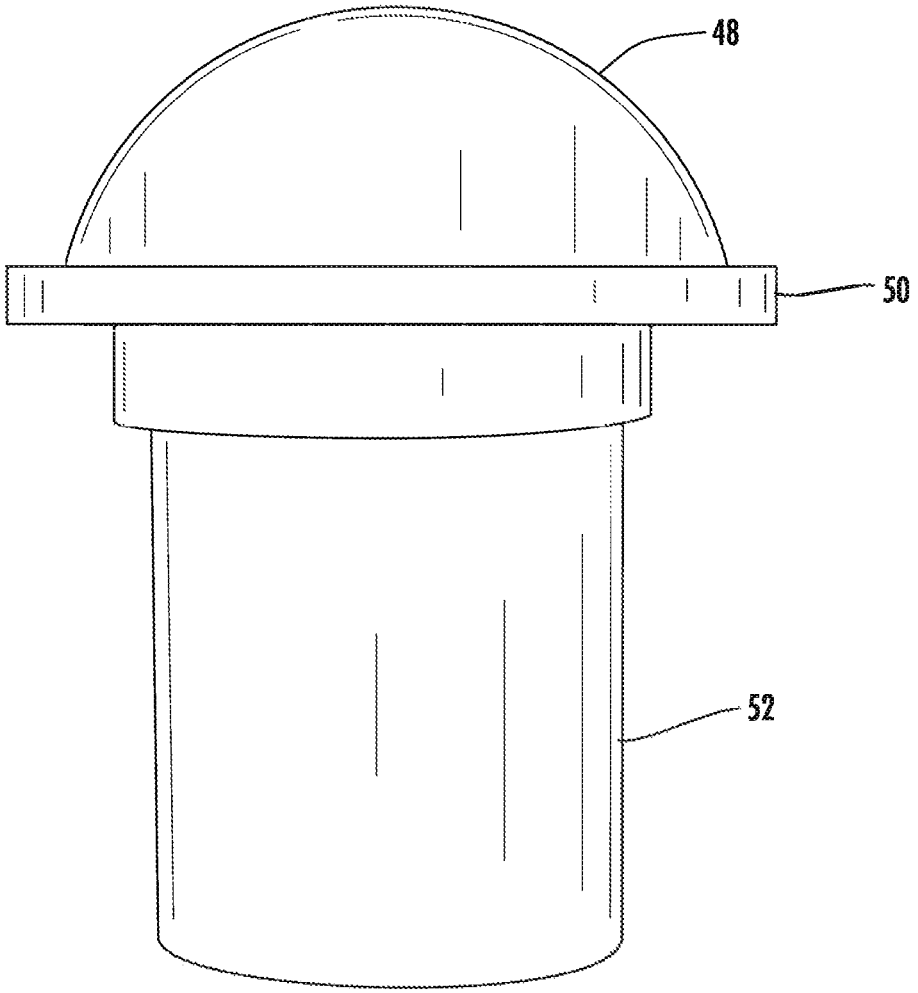
FIG. 13 shows a bottom view of a combination thru-hull fitting and drainage device according to one embodiment of the present disclosure.
Figure 14:
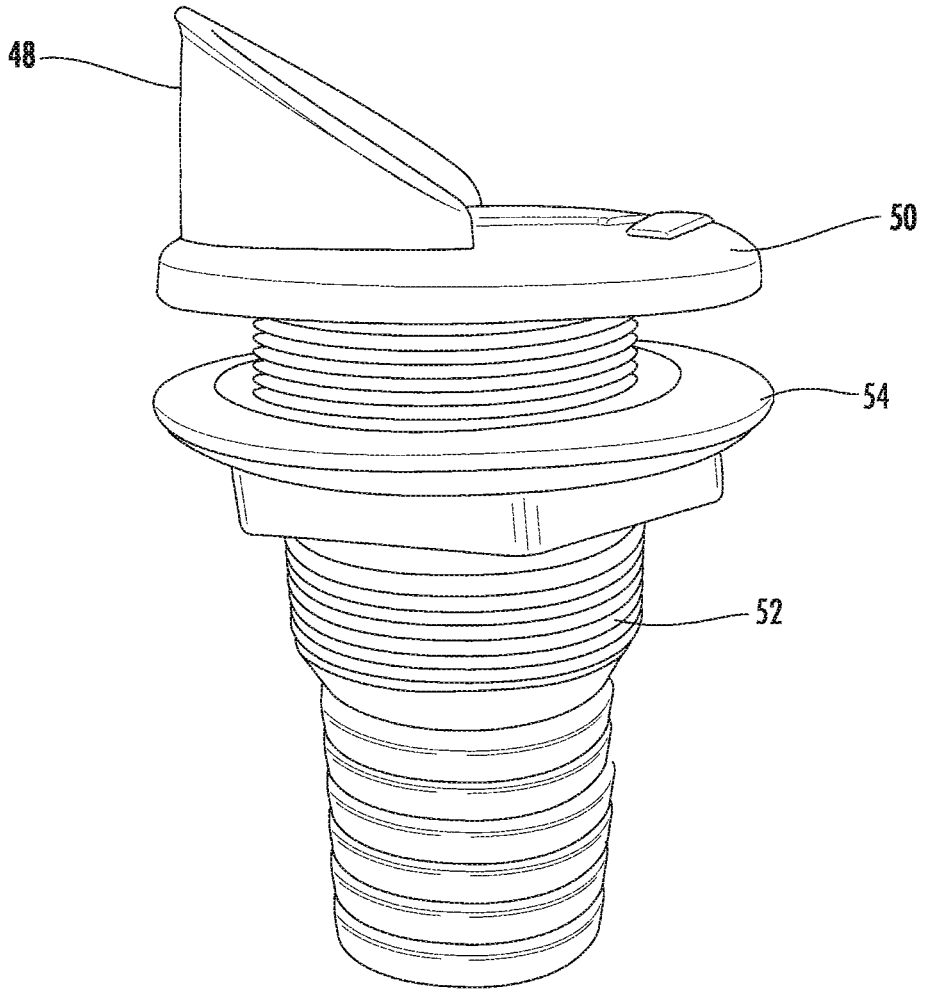
FIG. 14 shows a perspective side view of a combination thru-hull fitting and drainage device according to one embodiment of the present disclosure.

Referring to FIG. 7, the channel body 20 preferably includes a lip 42 formed adjacent the tip 28 of the drainage device 10. The lip 42 is preferably formed on a lower surface 44 of the channel body 20 and projects downwardly from the lower surface 44 of the channel body 20. The lip 42 extends at least partially across a width of the tip 28 of the channel body 20. The lip 42 preferably extends across a portion of the tip 28 of the channel body 20 such that the lip 42 is aligned with the second end 40 of the groove 36. The lip 42 prevents water from the channel body 20 and groove 36 from flowing along the lower surface 44 of the channel body 20 and back to the hull 14 of the vessel.

Referring now to FIGS. 8-14, in one embodiment a combined thru hull drainage device 46 includes a drainage channel 48 molded or otherwise formed on a thru hull flange 50 prior to installation of the drainage device 46. The combined thru hull drainage device 46 includes a threaded body 52 and a nut 54 threadably engaged with the threaded body 52. The drainage device 48 of the combined thru hull drainage 46 is formed according to the description above of the drainage device 10 shown in FIGS. 1-7 and preferably includes groove 56 formed in the drainage channel 48 for directing water away from a hull of a boat.

The drainage channel 48 is attached to the thru hull flange 50 prior to installation of the combined thru hull drainage device 46 on a hull of a boat. The drainage channel 48 may be attached, for example, with an adhesive or by welding of a material of the drainage channel 48 to the thru hull flange 50. The thru hull flange 50 and threaded body 52 are preferably formed of a harder plastic, such as a plastic typically used on existing thru hull fittings. The drainage channel 48 is formed of a softer and more flexible material than a material of the thru hull flange 50 such that the drainage channel 48 is deformable relative to the thru hull flange 50. For example, the drainage channel 48 may be formed of a thermoplastic elastomer, such as commercially available ENFLEX or other related materials. The thermoplastic elastomer provides sufficient weatherability and flexibility such that the device is suited for marine applications.

The combined thru hull drainage device 46 is preferably installed on a boat during construction of the boat or, alternatively, may be installed on a boat by replacing an existing thru-hull fitting. To install the combined thru hull drainage device 46, the thru hull flange 50 is placed against an outer surface of a hull of the boat with the threaded body 52 extending into the boat through a bore in the hull of the boat. The nut 54 engages the threaded body 52 behind the hull of the boat, thereby securing the combined thru hull drainage device to the boat.

Figure 15:
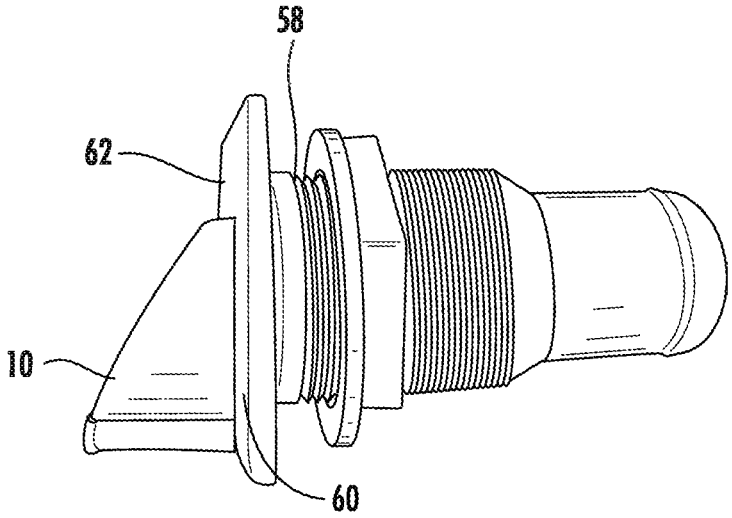
FIGS. 15-17 show a modified thru-hull fitting and drainage device according to one embodiment of the present disclosure.
Figure 16:
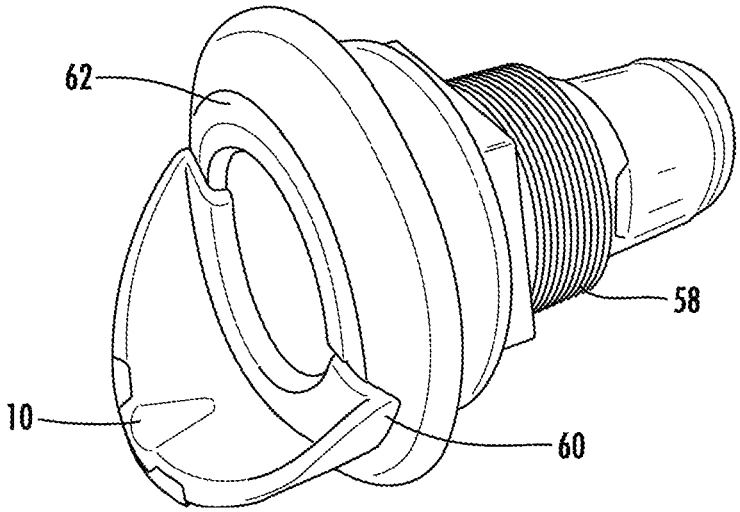
Figure 17:
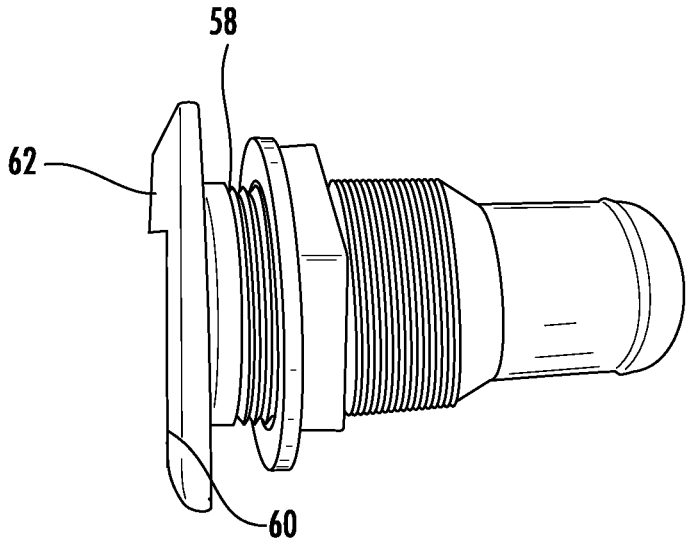

Referring to FIGS. 15-17, in one embodiment the drainage device 10 is mounted to or formed on a modified thru-hull fitting 58. The modified thru-hull fitting 58 includes an attachment portion 60 (FIG. 17) such as a flat portion formed on a face 62 of the thru-hull fitting 58. The attachment portion 60 is preferably located on a lower portion of the face 62 and sized to accept the drainage device 10 on the face 62 of the thru-hull fitting 58, such as with the adhesive as described above. An upper portion of the face 62 is preferably rounded or otherwise shaped similar to a traditional thru-hull such that a smooth transition is formed from the face 62 of the modified thru-hull fitting 58 and the drainage device 10, as shown in FIG. 16.

In operation, a user installs the drainage device 10 adjacent to a thru-hull fitting of a vessel such that the flange 22 abuts the hull of the vessel and is placed around a bottom portion of the thru-hull fitting. The user removes the non-adhesive strip to expose the adhesive second side and presses the drainage device 10 against the hull to substantially secure the drainage device 10 to the hull of the boat. The drainage device 10 is secured to the hull without requiring removal or loosening of the thru-hull fitting.

After attaching the drainage device 10 to the hull of the boat adjacent the thru-hull fitting, any fluid that is discharged from the thru-hull fitting is collected in the channel body 20 of the drainage device 10 and deposited away from the hull of the boat. Fluid discharged from the thru-hull fitting is collected in the channel body and moves away from the hull of the boat to the tip 28 of the drainage device. From the tip the fluid flows substantially downward into a body of water below the vessel. The drainage device 10 directs fluid away from the hull of the boat such that the fluid does not contact the hull of the boat before reaching the body of water. To remove the drainage device 10, a user may scrape the adhesive from the hull or otherwise use an adhesive remover to release the drainage device 10 from the hull of the boat.

Figure 18:
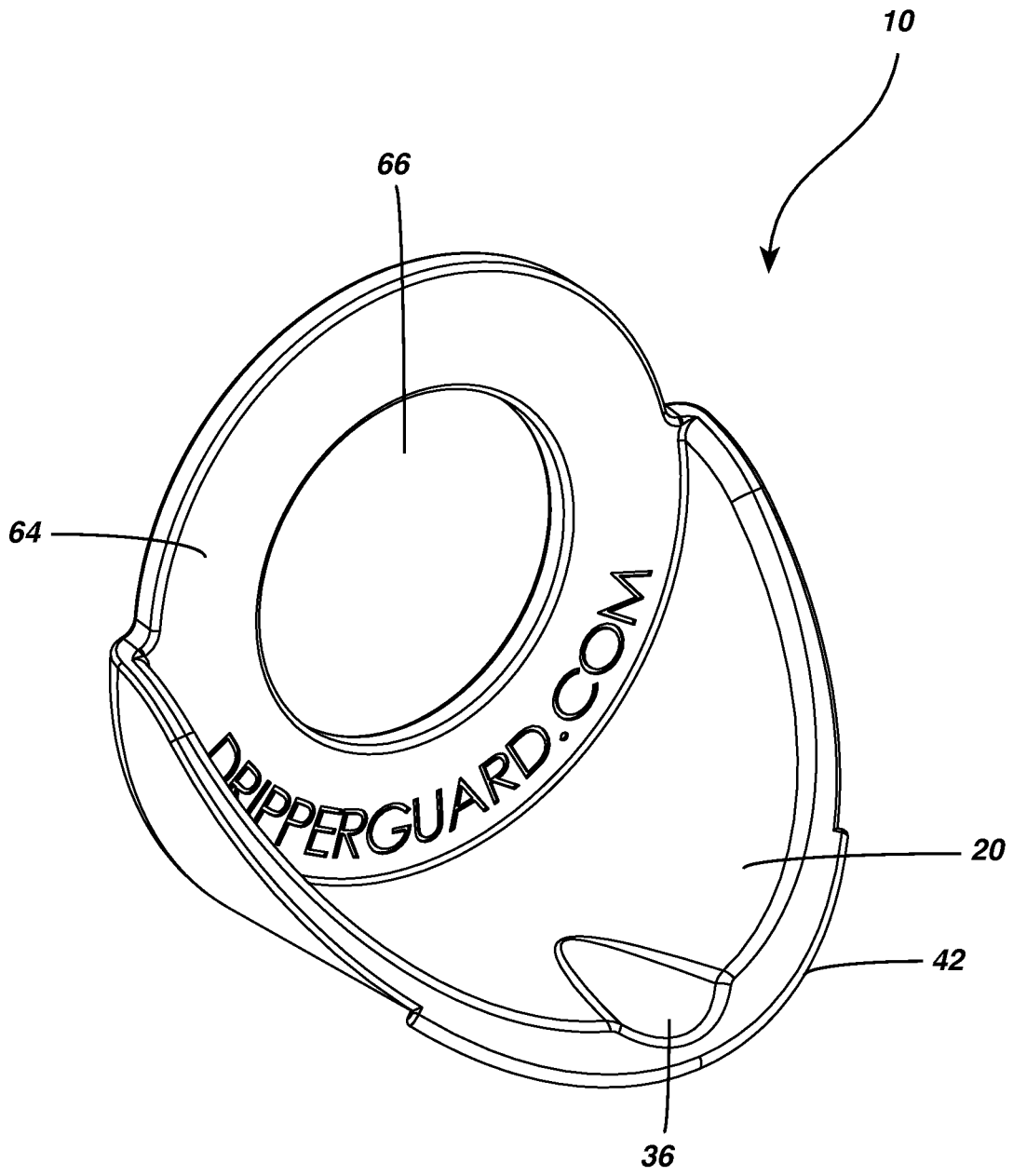
FIG. 18 shows a perspective view of a drainage device including a ring for mounting the drainage device to a thru-hull according to one embodiment of the present disclosure.
Figure 19:
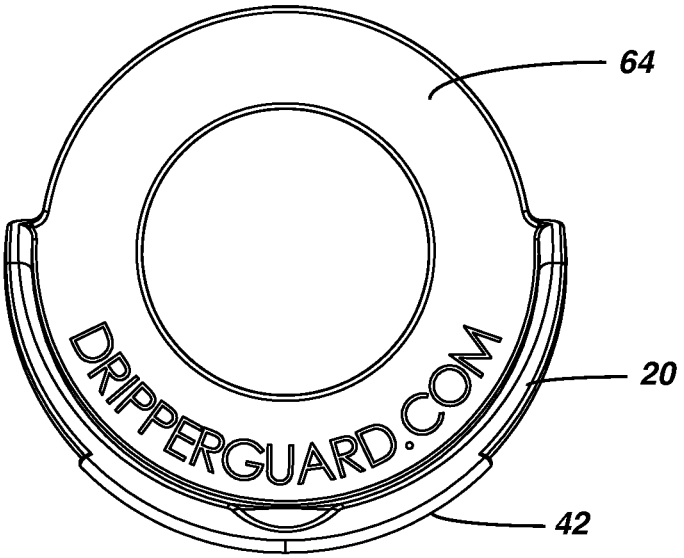
FIG. 19 shows a front view of a drainage device including a ring for mounting the drainage device to a thru-hull according to one embodiment of the present disclosure.
Figure 20:
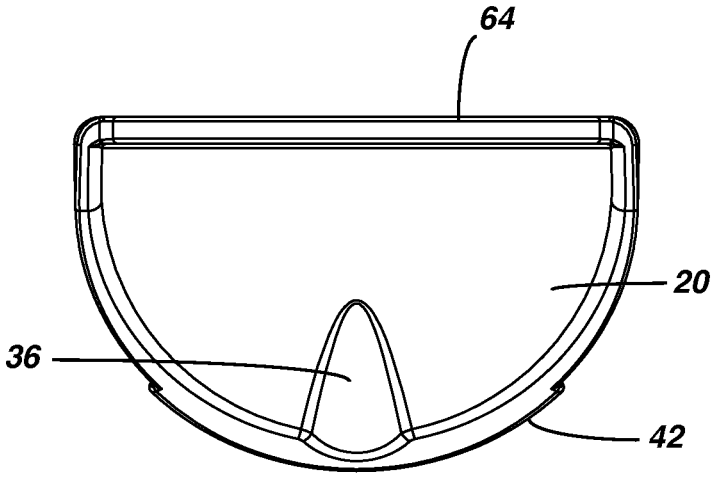
FIG. 20 shows a top view of a drainage device including a ring for mounting the drainage device to a thru-hull according to one embodiment of the present disclosure.
Figure 21:
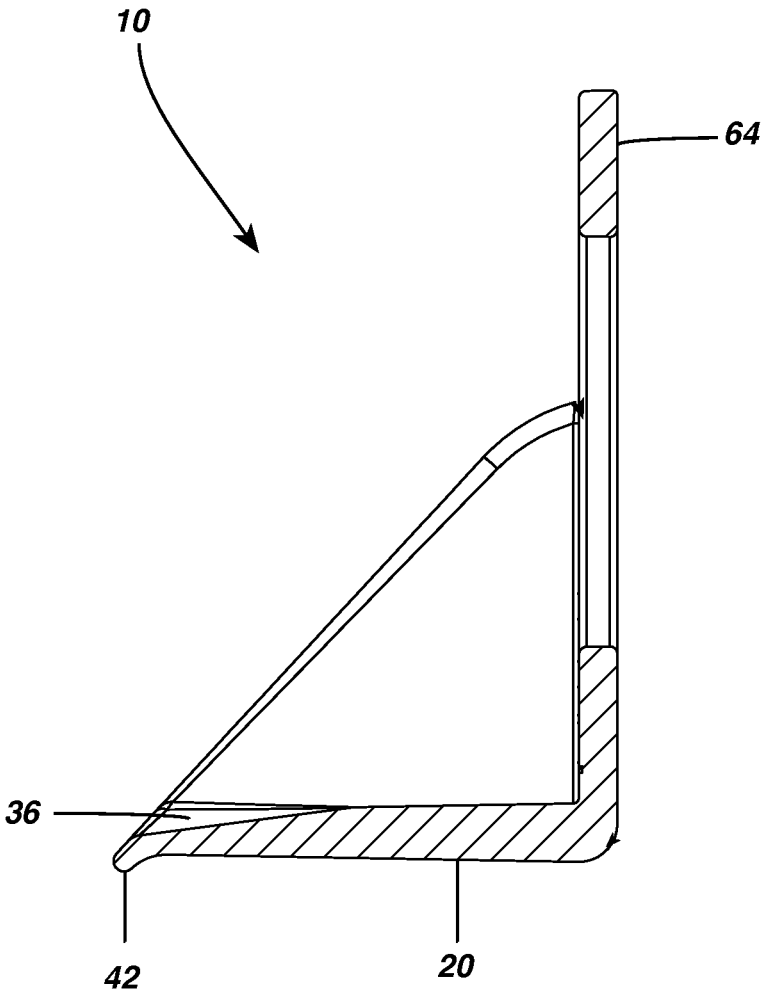
FIG. 21 shows a cross-sectional side view of a drainage device including a ring for mounting the drainage device to a thru-hull according to one embodiment of the present disclosure.

An additional embodiment of the drainage device 10 is shown in FIG. 18. The device of FIG. 18 includes the channel body 20, lip 42, and groove 36 as described above. The channel body 20 is preferably formed on a ring 64 having an aperture 66 formed therethrough. The ring 64 is preferably formed of the same resiliently flexible material of the channel body 20 and is sized to fit around a thru-hull of a boat for installation. The ring 64 and channel body 20 are preferably co-molded as a single piece. Sides of the channel body 20 are conform around an outside of the ring 64 and preferably extend at least halfway up the ring 64 as shown in FIG. 19. A width of the channel body 20 is preferably greater than a diameter of the ring 64 such that the channel body 20 conforms around a diameter of a thru-hull fitting when the drainage device 10 is installed.

Figure 22:
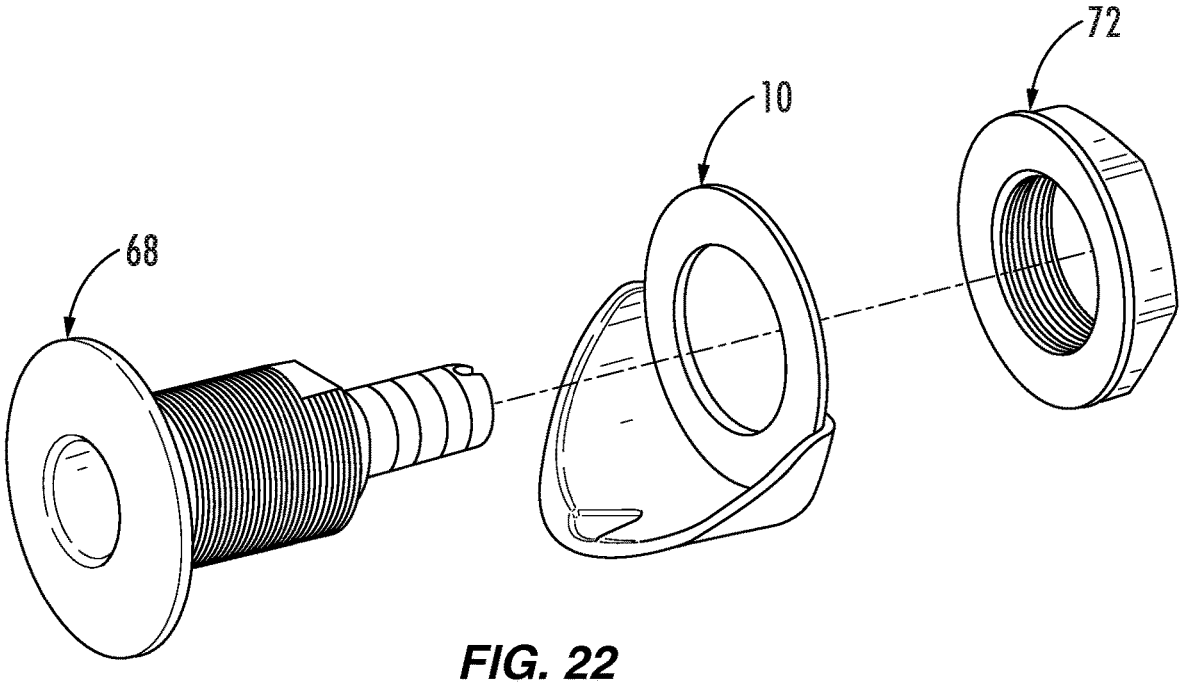
FIG. 22 shows an exploded view of a drainage device and thru-hull according to one embodiment of the present disclosure.
Figure 23:
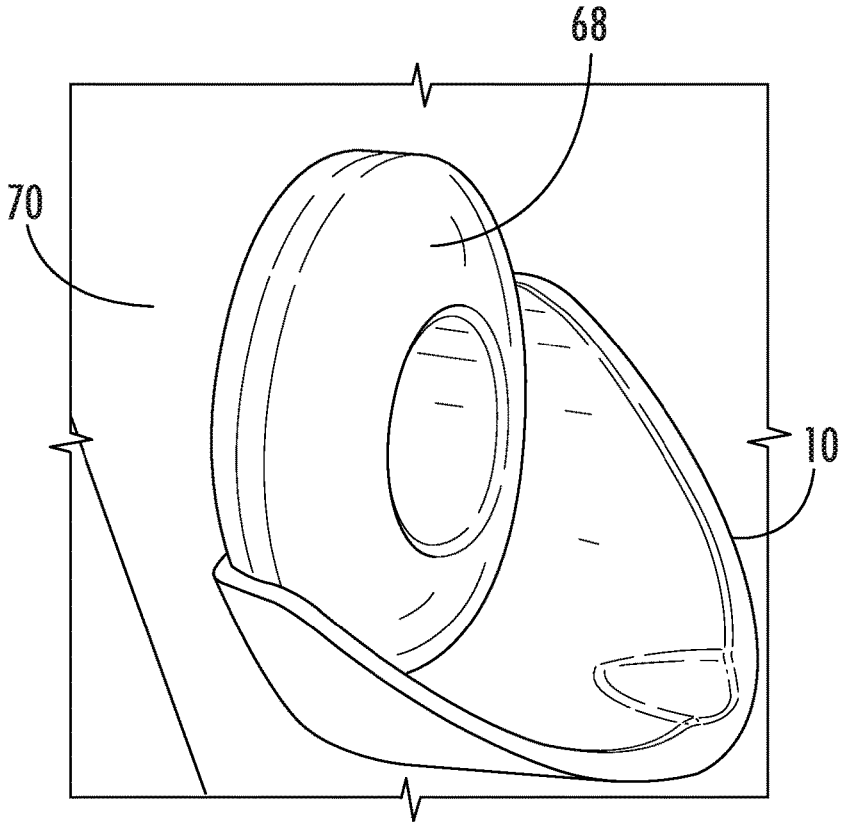
FIG. 23 shows a drainage device installed on a thru-hull of a boat according to one embodiment of the present disclosure.

Referring now to FIGS. 22 and 23, the drainage device 10 is installed on a boat between a thru-hull body 68 and a hull 70 of the boat. The thru-hull body 68 is maintained against the hull 70 of the boat with a threaded nut 72 that engages the thru-hull body 68 behind the hull 70. The ring 64 is preferably sized such that an outer edge of the ring 64 is flush with an outer edge of the thru-hull body 68 when installed on a boat. The resiliently flexible ring 64 is compressed between the hull 70 and the thru-hull body 68 such that the ring 64 creates a seal to prevent entry of water into the hull 70 around the thru-hull body 68.

The marine thru-hull fitting drainage device advantageously directs fluid discharged from a thru-hull fitting of a vessel away from a hull of the vessel such that the fluid does not contact the hull and leave a stain or streak on the hull of the vessel. The drainage device is readily installed on the vessel. The drainage device conforms around a shape of the thru-hull fitting to prevent fluid discharged from the thru-hull fitting to contact the hull of the vessel, and directs fluid to a point that is distal from a surface of the hull to prevent any stains or streaks from forming on the hull of the vessel.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A marine thru-hull fitting drainage device for directing fluid away from a thru-hull fitting installed through a bore in a hull of a vessel, the drainage device comprising:

a channel body having a substantially U-shaped cross-sectional area along a length of the body such that the body forms a channel for directing fluid within the body, the body extending from a first end proximate to the hull of the vessel when the drainage device is installed and a second end that is distal from the hull of the vessel, wherein the second end extends beyond an edge of the thru-hull fitting, the channel body further comprising a groove formed at a center of the channel body;

a ring having an inner diameter that is at least as wide as a diameter of the bore in the hull of the vessel, the channel body attached to the ring at the first end of the channel body;

wherein the drainage device is secured to the hull of the vessel by securing the ring between the thru-hull and the hull of the vessel.

2. The marine thru-hull fitting drainage device of claim 1, wherein the channel body and ring are formed of a resiliently flexible material.

3. The marine thru-hull fitting drainage device of claim 1, the channel body tapering in width from the first end adjacent to the hull to the second end of the channel body.

4. The marine thru-hull drainage device of claim 1, wherein the groove has a tapered width such that a width of the groove expands from a narrower width at a first end to a wider width at a second end of the groove, wherein the second end of the groove is adjacent the second end of the channel body.

5. The marine thru-hull drainage device of claim 1, further comprising a lip formed on a lower surface of the channel body and extending downward from the channel body at the second end of the channel body.

6. The marine thru-hull drainage device of claim 5, further comprising a lip formed on a lower surface of the channel body and extending downward from the channel body at the second end of the channel body, the lip aligned with the groove formed in the channel body.

7. The marine thru-hull drainage device of claim 1, wherein the channel body has a width that is greater than a width of the ring.

8. A marine thru-hull fitting drainage device comprising:

a channel body having a substantially U-shaped cross-sectional area along a length of the body such that the body forms a channel for directing fluid within the body, the body extending from a first end proximate to the hull of the vessel when the drainage device is installed and a second end that is distal from the hull of the vessel, wherein the second end extends beyond an edge of the thru-hull fitting, the channel body tapering in width from the first end adjacent to the hull to the second end of the channel body, the channel body further comprising a groove formed at a center of the channel body;

a ring having an inner diameter that is at least as wide as a diameter of the bore in the hull of the vessel, the channel body attached to the ring at the first end of the channel body;

wherein the drainage device is secured to the hull of the vessel by securing the ring between the thru-hull and the hull of the vessel; and wherein the channel body and ring are formed of a resiliently flexible material.

9. The marine thru-hull drainage device of claim 8, wherein the groove has a tapered width such that a width of the groove expands from a narrower width at a first end to a wider width at a second end of the groove, wherein the second end of the groove is adjacent the second end of the channel body.

10. The marine thru-hull drainage device of claim 8, further comprising a lip formed on a lower surface of the channel body and extending downward from the channel body at the second end of the channel body.

11. The marine thru-hull drainage device of claim 8, further comprising a lip formed on a lower surface of the channel body and extending downward from the channel body at the second end of the channel body, the lip aligned with the groove formed in the channel body.

12. The marine thru-hull drainage device of claim 8, wherein the channel body has a width that is greater than a width of the ring.

13. A marine thru-hull fitting drainage device for directing fluid away from a thru-hull fitting installed through a bore in a hull of a vessel, the drainage device comprising:

a channel body having a substantially U-shaped cross-sectional area along a length of the body such that the body forms a channel for directing fluid within the body, the body extending from a first end proximate to the hull of the vessel when the drainage device is installed and a second end that is distal from the hull of the vessel, wherein the second end extends beyond an edge of the thru-hull fitting;

a lip formed on a lower surface of the channel body and extending downward from the channel body at the second end of the channel body;

a ring having an inner diameter that is at least as wide as a diameter of the bore in the hull of the vessel, the channel body attached to the ring at the first end of the channel body;

wherein the drainage device is secured to the hull of the vessel by securing the ring between the thru-hull and the hull of the vessel.

* * * * *